United States Patent [19]

Kurasch et al.

[11] Patent Number: 4,633,091

[45] Date of Patent: Dec. 30, 1986

[54] CONTAINER FOR THE STORAGE, TRANSPORTATION AND ULTIMATE DISPOSAL OF LOW LEVEL NUCLEAR WASTES

[75] Inventors: David H. Kurasch, Penn Hills; George V. B. Hall, Bethel Park, both of Pa.; Stephen C. Cossel; Paul A. Miskimin, both of Carlsbad, N. Mex.

[73] Assignee: Westinghouse Electric Corp., Pittsburgh, Pa.

[21] Appl. No.: 659,991

[22] Filed: Oct. 12, 1984

[51] Int. Cl.[4] ..... G21F 5/02

[52] U.S. Cl. ..... 250/506.1; 220/402; 220/410; 220/DIG. 21; 220/DIG. 29; 252/633; 376/272; 376/412

[58] Field of Search ..... 252/633, 626; 250/506.1, 507.1, 515.1; 376/412, 272; 220/1 R, 401, 402, 408, 410, DIG. 21, DIG. 29

[56] References Cited

U.S. PATENT DOCUMENTS

| | | | |
|---|---|---|---|
| 4,016,096 | 4/1977 | Meyer | 252/633 |
| 4,209,420 | 6/1980 | Larker | 252/633 |
| 4,302,680 | 11/1981 | Ahner et al. | 250/506.1 |
| 4,326,918 | 4/1982 | Lapides | 252/633 |
| 4,330,711 | 5/1982 | Ahner et al. | 250/506.1 |
| 4,366,095 | 12/1982 | Takats et al. | 252/633 |
| 4,508,969 | 4/1985 | Janberg et al. | 250/506.1 |
| 4,528,454 | 7/1985 | Baatz et al. | 250/506.1 |

FOREIGN PATENT DOCUMENTS

| | | | |
|---|---|---|---|
| 0024502 | 3/1981 | European Pat. Off. . | |
| 0150811 | 9/1981 | Fed. Rep. of Germany | 250/506.1 |
| 3222764 | 12/1983 | Fed. Rep. of Germany | 250/506.1 |
| 3227512 | 1/1984 | Fed. Rep. of Germany . | |
| 3244727 | 6/1984 | Fed. Rep. of Germany . | |
| 3415894 | 1/1985 | Fed. Rep. of Germany . | |
| 2375696 | 7/1978 | France . | |
| 2142869 | 1/1985 | United Kingdom . | |

*Primary Examiner*—Stephen J. Lechert, Jr.
*Assistant Examiner*—Howard J. Locker
*Attorney, Agent, or Firm*—Joel Petrow

[57] ABSTRACT

Cask-like steel container for one-site storage, later-shipment and permanent disposal of low-level-radiation nuclear waste material. Container has configuration of a hollow cylinder with heavy walls. Bottom portion of container is affixed to cylindrical sides with a double weld. Steel top member has an annular recess as does the top portion of the cylindrical sides, with hermetic, radiation-resistant gasket material included therebetween, and the container top and sides are bolted together. The top member has spaced heavy eyelet-like members affixed thereto for handling the container.

4 Claims, 5 Drawing Figures

FIG. 4
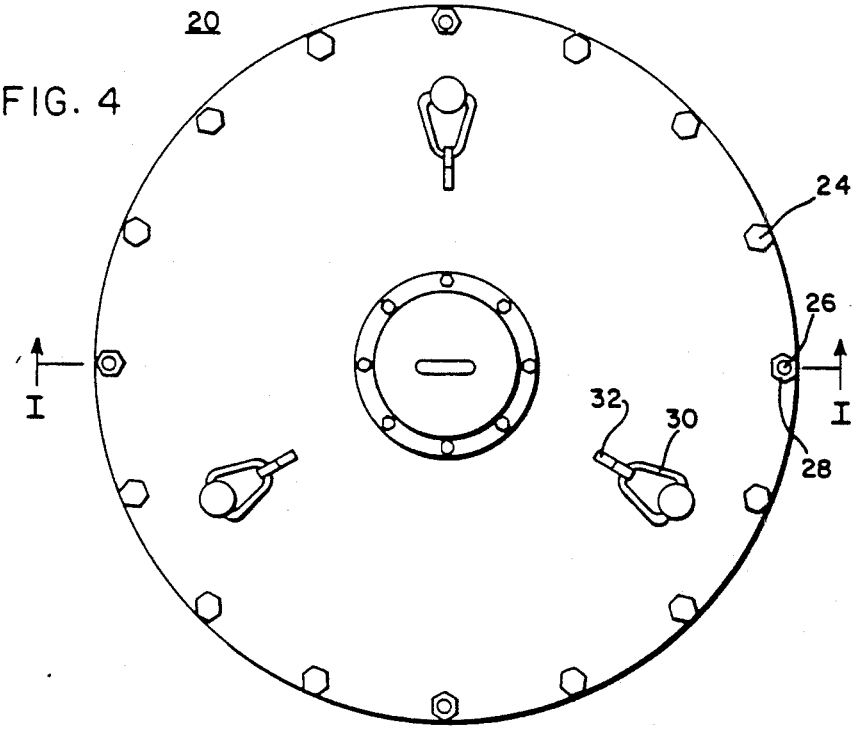
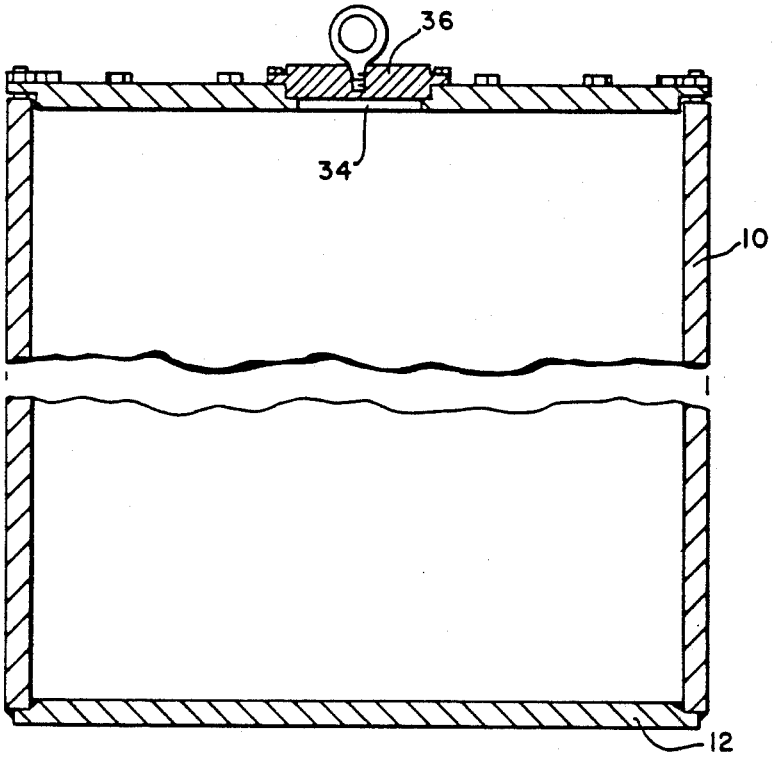
FIG. 1

CONTAINER FOR THE STORAGE, TRANSPORTATION AND ULTIMATE DISPOSAL OF LOW LEVEL NUCLEAR WASTES

BACKGROUND OF THE INVENTION

Nuclear wastes produced by waste generators such as nuclear reactors are generally stored at the generator site for a short time, transported to a disposal facility, and disposed. The accumulated cost including the handling, storage, transportation and disposal of this waste is high. In addition, the potential for personnel exposure to radiation could be reduced by reducing the number of handling sequences required by current systems.

Currently, waste generators store process waste containers temporarily in on-site shielded buildings or containers or both, transfer the waste containers to transportation casks and at the disposal site, empty the casks. Two separate casks, interim storage and transportation are required in addition to the container holding the wastes. Four instances of possible human exposure during handling occur: placing the waste in the disposal container; placing the container into the interim storage cask or building; taking the container out of the interim storage cask and placing it into the transportation cask; and taking the container out of the transportation cask and putting it into ultimate disposal. Large expenditures are required to construct and operate the building for holding the on-site storage containers, transportation cask rental fees, and disposal.

A temporary shortage of disposal facilities may mean that generating facilities must provide for much more temporary storage of nuclear waste and also consider transportation of large quantities of the waste in a relatively short period once a disposal facility is available.

SUMMARY OF THE INVENTION

The present invention is a cask designed for the on-site storage, subsequent transportation, and burial of low level nuclear wastes. Physically the cask is a thick-walled, self-shielded cylindrical container dimensioned for radiation control and transportation requirements. The low-level waste or individual containers of waste are placed within the cask and can be stored at the site either inside a temporary building or out-of-doors. The cask has sufficient strength to comply with transportation regulations and hence, can be transported to a final disposal site with no further repackaging of the contained waste.

At the disposal site the cask and its contents can be disposed of as-is with the option of retrieving the cask at a later data. Alternately, if individual containers are used within the cask they may be removed at the disposal site and buried and the cask recovered.

BRIEF DESCRIPTION OF THE DRAWINGS

FIG. 1 is a cross-sectional elevational view of the entire storage/transportation/disposal cask.

FIG. 4 is a top planar view of the cask top member.

DESCRIPTION OF THE PREFERRED EMBODIMENT

As shown in FIG. 1, a hollow right circular cylindrical steel body 10 is constructed for example of two similar pieces of steel, each being formed into a semi-annular configuration of predetermined dimensions. In the preferred embodiment, the two semi-annular pieces of steel are abutted to form an annular configuration with an outside diameter of 80 inches with the abutting parts joined by continuous welds that completely penetrate the pieces of steel. The cylindrical shell thus created is 78.12 inches high made from steel plate which is 3 inches thick. This provides adequate shielding for the storage and shipment of low specific activity wastes commonly generated by light water reactors. For example, the dose rate from cobalt 60 contained in a solidified resin is 31.4 millirem per hour per $\mu$Ci per cubic centimeter of the isotope when measured at the side and in contact with the cask.

Figure 2:
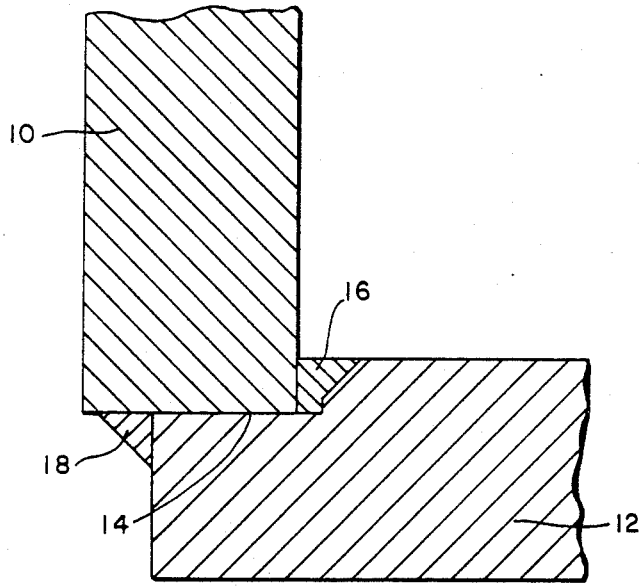
FIG. 2 is a detailed cross-section of the lower portion of the cask.

The cask-like container has a bottom portion 12 made of steel with a circular configuration having dimensions slightly smaller than the cylinder, 77½ inches rather than 80 inches and a thickness similar to that of the cylinder. As shown in FIG. 2, the bottom of the cask has a portion of the material around the periphery removed, for instance, three-quarters of one inch in depth and 2.31 inches radially from the periphery of the cask bottom.

This portion removed around the periphery of the cask bottom forms a ledge 14 which is spaced slightly from the inside of the cylinder by 0.31 inches upon which the cylinder can sit. Two continuous circular boundaries are formed, one on the cask interior 16, and one on the exterior 18 where the bottom of the cask can be welded to the hollow cylinder.

Figure 3:
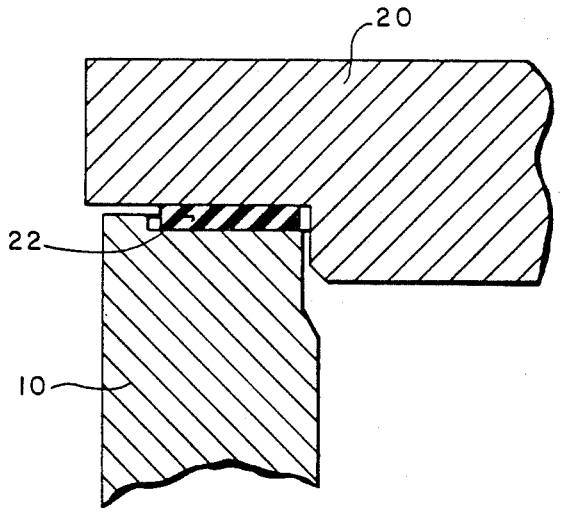
FIG. 3 is a detailed cross-section of the upper portion of the cask and the cask top member.

As shown in FIG. 3, the cask is closed with a steel top member 20 having a circular configuration of predetermined dimensions that are slightly larger than the exterior dimension of the hollow right circular cylinder. The top member is sealed to the cylinder by use of a flat gasket 22 made of a material such as Neoprene between the top member and cylinder, and held by sixteen threaded fasteners such as bolts 24 or studs 26 and nuts 28 that pass through the top member and fasten to the cylinder, as shown in FIG. 4.

At least several stud/nut combinations are used in the sixteen positions to aid in the alignment of the top member when placed onto the cylinder.

The top member has lifting rings 30 attached to its exterior surface for lifting the top member only or the entire cask. The lifting rings are rendered unusable by securing them against the top member during transportation by means of clamps 32.

Figure 5:
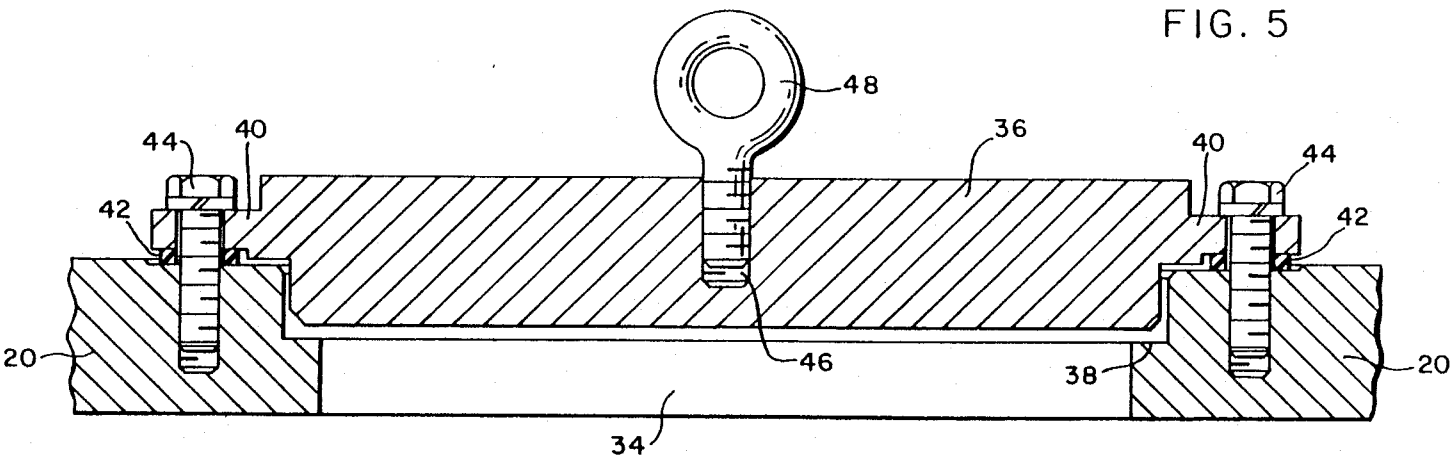
FIG. 5 is a cross-sectional view of the top member and the central lid.

As shown in FIGS. 1 and 5, the top member may also have a circular aperture 34 in the middle as a means for allowing the introduction and dewatering of the waste material and further comprises a separate, removable central lid 36. With the entire top member removed any desired apparatus can be inserted into the cask then the top member without the central lid is secured. The cask can then be filled and processed, such as being dewatered, through the central opening in the top member with the substantial shielding the top member provides intact.

Referring to FIG. 5, the aperture is a large opening near the outer surface of the top member and a small opening near the cask interior forming a ledge 38 around the interior perimeter of the aperture about half way between the interior and exterior surfaces of the top member.

The central lid adapted for closing the central aperture is smaller than the upper opening of the aperture but larger than the lower opening, and has a flange 40 around the outer perimeter that seals the lid to the remainder of the top member 20 by means of a gasket 42 and bolts 44. A threaded blind hole 46 in the central lid and an eyelet 48 with matching threads are used to lift the central lid onto the top member for sealing.

If desired, a liner, or inner container, made of a heavy material may be designed to fit within the above cask. For very low activity nuclear wastes the inner container can be removed with the waste material and permanently disposed, allowing reuse of the empty cask for storage and transportation of additional material.

Alternately, individual containers of waste not suitable for permanent disposal alone may simply be placed inside the cask without having to empty the contents. For example, fourteen 55-gallon drums can be accommodated in the above-described cask.

What is claimed is:

1. A cylindrical cask-like container adapted for the on-site storage, later shipment, and permanent disposal of low-level-radiation nuclear waste material, said cask-like container facilitating the handling and storage of such waste material while minimizing transfer of material and possible exposure which can be encountered in handling and shipping such material, said container comprising:

a hollow right-circular cylindrical steel body member with the thickness of said hollow steel body member being predetermined to reduce at the outer surface of said container the radiation that is generated by the waste material the cask-like container is adapted to retain to a predetermined, safe level;

a steel bottom portion of said cask-like container having a circular configuration of predetermined dimensions slightly smaller than that of said hollow right-circular body member, and a thickness similar to that of said hollow right-circular body member, a recessed annular-conformed portion of predetermined dimensions formed about the upper periphery of said bottom portion member and forming a ledge at the inner dimension thereof, said bottom portion member when interfitted into the bottom of said hollow right circular-member forming with the exterior surface of said right-circular member a recessed ledge of predetermined dimensions, and said ledge formed at the inner dimension of said recessed annular conformed portion of said bottom member spaced a small predetermined distance from the inner surface of said hollow right-circular body member, and the formed exterior and interior ledges comprising high strength weld sites which join both the exterior surfaces and interior surfaces of said hollow right-circular steel body member and said steel circular bottom member;

a steel top member portion of said cask-like container having a circular configuration of predetermined dimensions slightly larger than the exterior dimensions of said hollow cylindrical body member and a thickness similar to that of said hollow right-circular body member, the bottom portion of said top member having a recessed annular conformed portion of predetermined dimensions about the periphery thereof so that the bottom portion of said top member interfits into the top section of said hollow cylindrical member, the top surface of said hollow right-circular member also having a recessed annular section at the inner portion thereof, gasket means which is resistant to radiation generated by said waste material, said gasket means retained in the formed annular recessed portions proximate the top of said container to form a seal between the interfitted top member portion and the upper surface of said hollow right cylindrical member, and said top member affixed to said hollow right-circular member by a plurality of bolt means extending through said top portion and into said hollow right-circular member to compress said gasket means and form a hermetic seal therebetween and retain the waste material adapted to be stored in said cask-like container; and spaced heavy eyelet-type members affixed to the top portion of said top member to enable said cask-like container and top member to be lifted and handled.

2. The apparatus of claim 1 wherein said hollow right-circular cylindrical steel body member comprises:

two similar members each having a semi-annular cross-sectional configuration of predetermined dimensions, said two similar members abutting to display an annular cross-sectional configuration with the abutting portions thereof joined by continuous, complete penetration welds.

3. The cask-like container as specified in claim 1, wherein said top member portion contains a circular aperture for adding said waste material to said hollow cylindrical body member, said aperture having a larger diameter at the upper portion of said top member and a smaller diameter at the lower portion of said top member forming a ledge around the perimeter of the aperture, said ledge approximately equidistant between the upper and lower surfaces of said top member, and a lid having a diameter smaller than that of the upper portion of said top member but larger than that of the lower portion of said top member and a flange about the outer perimeter with means for sealing said like flange to said top member.

4. The cask-like container as specified in claim 1, wherein a heavy liner material is adapted to be interfitted into said cask-like container so that when said cask-like container is transported to a permanent disposal site with waste material contained therein, said liner can be removed with the waste material contained therein and permanently disposed, and said emptied cask-like container can then be reused for storage and transportation of additional nuclear waste material.

* * * * *